US006186809B1

(12) United States Patent
Kung

(10) Patent No.: US 6,186,809 B1
(45) Date of Patent: Feb. 13, 2001

(54) ELECTRONIC DEVICE WITH A FLOATING ELECTRICAL CONNECTOR UNIT

(75) Inventor: Shao-Tsu Kung, Taipei (TW)

(73) Assignee: Compal Electronics, Inc., Taipei (TW)

( * ) Notice: Under 35 U.S.C. 154(b), the term of this patent shall be extended for 0 days.

(21) Appl. No.: 09/457,289

(22) Filed: Dec. 9, 1999

(51) Int. Cl.[7] ..... H01R 13/64
(52) U.S. Cl. ..... 439/248
(58) Field of Search ..... 439/247, 248, 439/76.1, 142, 246; 399/111, 90, 1, 83; 361/399, 686, 727

(56) References Cited

U.S. PATENT DOCUMENTS

| | | | | |
|---|---|---|---|---|
| 4,780,793 | * | 10/1988 | Ohtsuki | 361/399 |
| 5,199,888 | * | 4/1993 | Condra et al. | 439/142 |
| 5,224,869 | * | 7/1993 | Lee | 439/142 |
| 5,552,959 | * | 9/1996 | Penniman et al. | 439/248 |
| 5,993,241 | * | 11/1999 | Olson et al. | 439/378 |
| 6,097,908 | * | 8/2000 | Uchiyama et al. | 399/111 |

* cited by examiner

*Primary Examiner*—Khiem Nguyen
*Assistant Examiner*—J. F Duverne

(74) *Attorney, Agent, or Firm*—Pillsbury Madison & Sutro LLP

(57) ABSTRACT

An electronic device includes a housing that has a side wall formed with an access opening therethrough. The opening has a length in a first direction, and a width in a second direction transverse to the first direction. A barrier is secured to the housing parallel to the side wall, and is spaced apart from the opening in a third direction transverse to the first and second directions so as to form a connector mounting space between the barrier and the side wall. An electrical connector unit includes a terminal holding seat having a front portion that projects outwardly of the housing through the opening, and a rear portion disposed in the connector mounting space. The front portion of the terminal holding seat has a cross-section smaller than size of the opening such that the terminal holding seat is movable relative to the housing. A contact terminal set is mounted in the terminal holding seat, and has a cable connecting portion that extends in the third direction through the rear portion of the terminal holding seat. A ribbon cable has a terminal mounting plate mounted on one end thereof. The cable connecting portion of the contact terminal set is mounted on the terminal mounting plate and is in electrical contact with the ribbon cable. The terminal mounting plate has an abutment face in sliding contact with the barrier.

9 Claims, 7 Drawing Sheets

ELECTRONIC DEVICE WITH A FLOATING ELECTRICAL CONNECTOR UNIT

BACKGROUND OF THE INVENTION

1. Field of the Invention

The present invention relates to an electronic device, more particularly to an electronic device with a floating electrical connector unit.

2. Description of the Related Art

Computer peripheral devices, such as compact disk drives, hard disk drives and battery devices, are provided with electrical connector units for establishing electrical connection with corresponding electrical connectors inside a computer housing. It is noted that the electrical connector units on the computer peripheral devices must be in perfect alignment with the corresponding electrical connectors inside the computer housing in order to permit installation of the computer peripheral devices. Perfect alignment, however, cannot be ensured due to tolerances during the manufacture of the computer peripheral devices and the computer.

To overcome the aforesaid problem, it has been proposed heretofore to provide a floating electrical connector unit on a computer peripheral device for mating with a corresponding electrical connector that is fixed inside the computer housing. Because the floating electrical connector that is slightly movable relative to the housing of the computer peripheral device, it can be easily aligned with the corresponding electrical connector inside the computer housing for mating therewith.

FIGS. 1 and 2 show a computer peripheral device having a floating electrical connector unit 2 mounted on a housing 1 thereof. The housing 1 has a side wall 11 formed with an elongated access opening 13 therethrough. A pair of raid-defining guards 15 are disposed on two opposite edges of the access opening 13. The electrical connector unit 2 includes a contact terminal set (not visible), a flexible ribbon cable 23, and a dielectric terminal holding seat 20. The dielectric terminal holding seat 20 is disposed in the housing 1 and has a front portion 201 that projects outwardly of the housing 1 through the access opening 13, and a rear portion 202 that extends from the front portion 201 inwardly of the housing 1. The front portion 201 of the terminal holding seat 20 has a cross-section smaller than the size of the access opening 13 such that the terminal holding seat 20 is movable relative to the housing 1. The contact terminal set is mounted in the terminal holding seat 20, and has a cable connecting portion that extends through the rear portion 202 of the terminal holding seat 20. On end of the ribbon cable 23 is clamped between a pair of terminal mounting plates 21. The cable connecting portion of the contact terminal set connects electrically with the ribbon cable 23, and is mounted on the terminal mounting plate 21. The terminal mounting plates 21 have opposite ends that extend respectively into the rail-defining guards 15 such that the terminal holding seat 20 is movable along the access opening 13, and such that the terminal holding seat 20 is prevented from removal from the housing 1 via the access opening 13.

Some disadvantages of the aforesaid arrangement are as follows:

(i) The range movement of the electrical connector unit 2 is severely limited due to the use of the rail-defining guards 15.

(ii) Because the terminal mounting plates 21 are supported solely at the opposite ends by the rail-defining guards 15, they may deform after frequent plug-in action of a complementary electrical connector 2'.

SUMMARY OF THE INVENTION

Therefore, the object of this invention is to provide an electronic device, such as a computer peripheral device, which is clear of the aforementioned drawbacks that are commonly associated with the aforesaid prior art.

Accordingly, an electronic device of the present invention includes a housing, a barrier, and an electrical connector unit. The housing has a side wall formed with an access opening therethrough. The access opening has a first length in a first direction, and a first width in a second direction transverse to the first direction. The barrier is secured to the housing and extends parallel to the side wall. The barrier is spaced apart from the access opening in a third direction transverse to the first and second directions so as to form a connector mounting space between the barrier and the side wall. The electrical connector unit includes a dielectric terminal holding seat disposed in the housing and having a front portion that projects outwardly of the housing through the access opening, and a rear portion that extends from the front portion in the third direction and that is disposed in the connector mounting space. The front portion of the terminal holding seat has a cross-section smaller than the size of the access opening such that the terminal holding seat is movable relative to the housing. The contact terminal set is mounted in the terminal holding seat, and has a cable connecting portion that extends in the third direction through the rear portion of the terminal holding seat. A ribbon cable has a terminal mounting plate mounted on one end thereof. The cable connecting portion of the contact terminal set is connected electrically with the ribbon cable and is mounted on the terminal mounting plate. The terminal mounting plate is disposed in the connector mounting space and has an abutment face in sliding contact with a contact face of the barrier.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
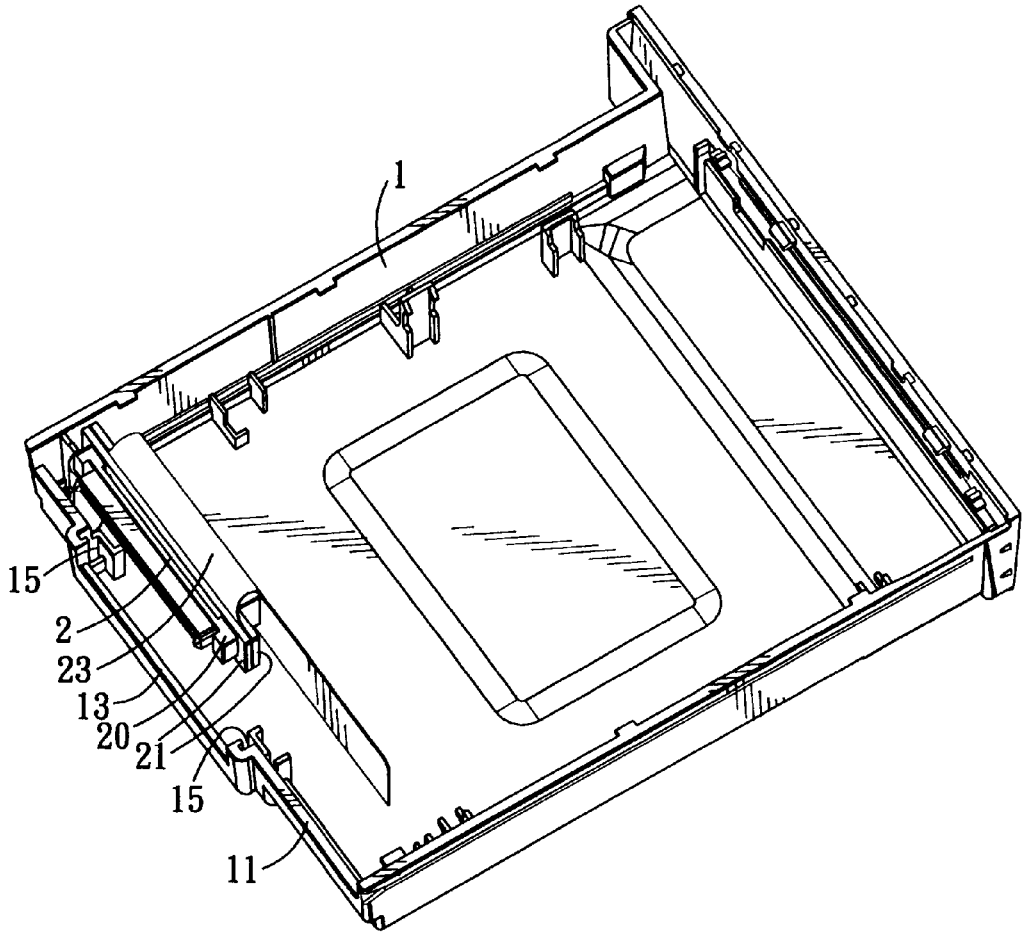
FIG. 1 PRIOR ART
FIG. 1 is a perspective view of an electronic device with a conventional floating electrical connector unit.
Figure 2:
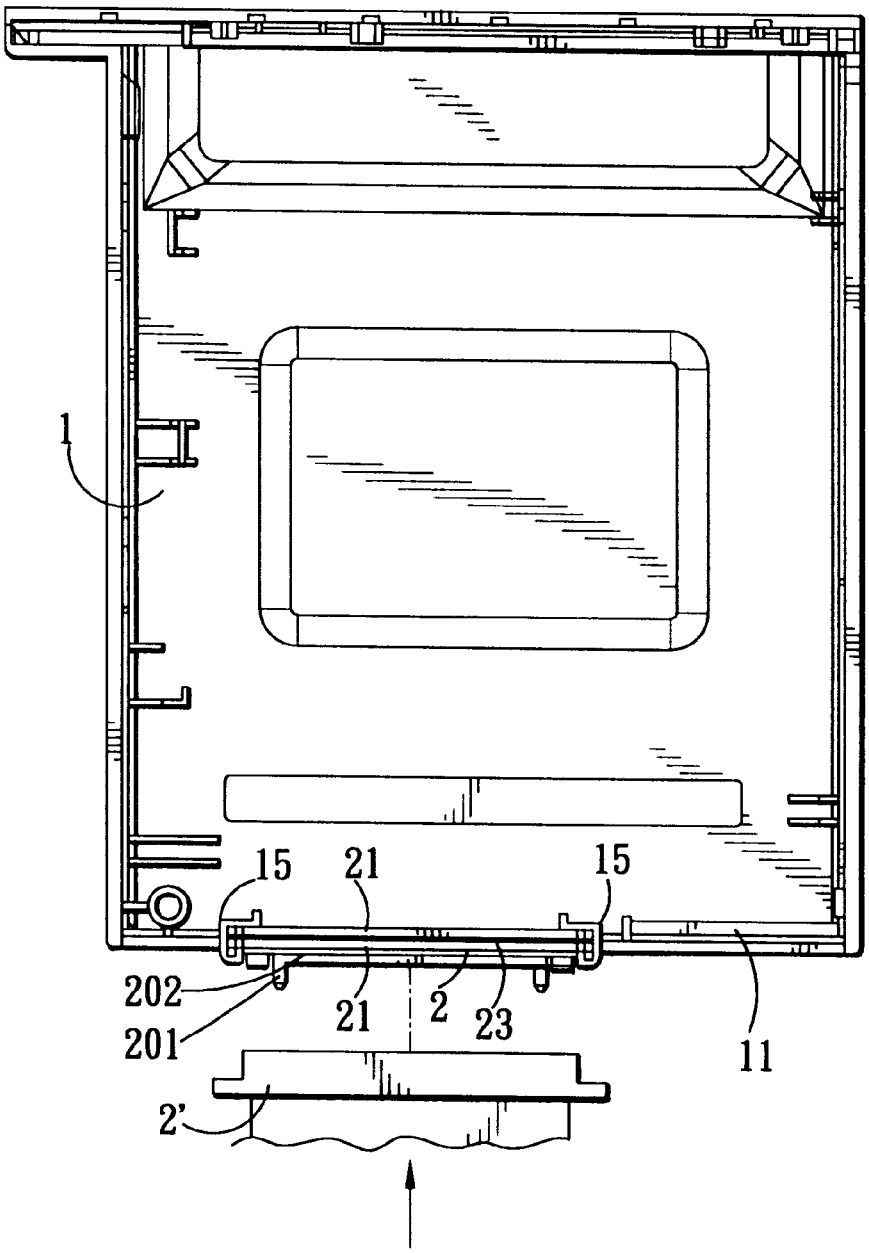
FIG.2 PRIOR ART
FIG. 2 illustrates how the electrical connector unit of FIG. 1 mates with a complementary electrical connector.

Before the present invention is described in greater detail, it should be noted that like elements are denoted with the same reference numerals throughout the disclosure.

Figure 3:
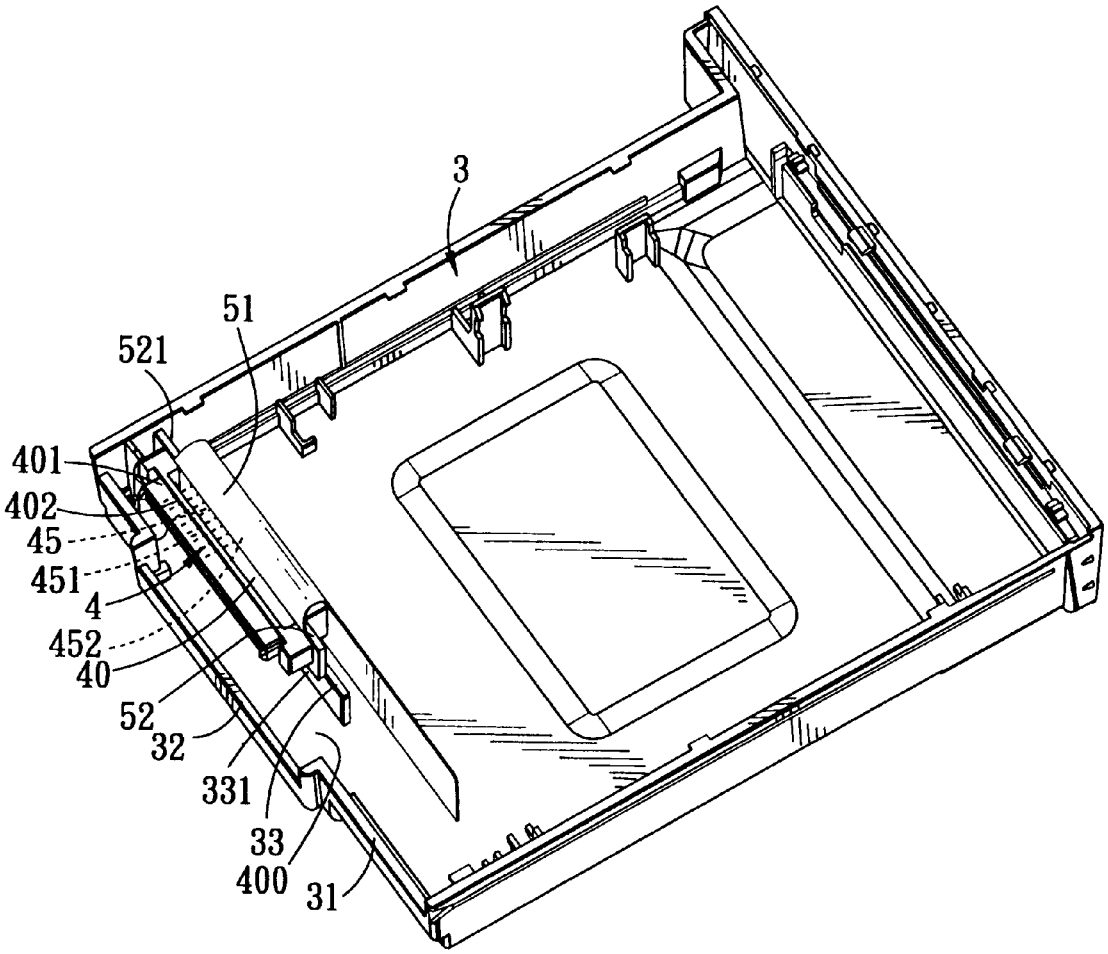
FIG. 3 is a perspective view of a preferred embodiment of an electronic device of the present invention.
Figure 4:
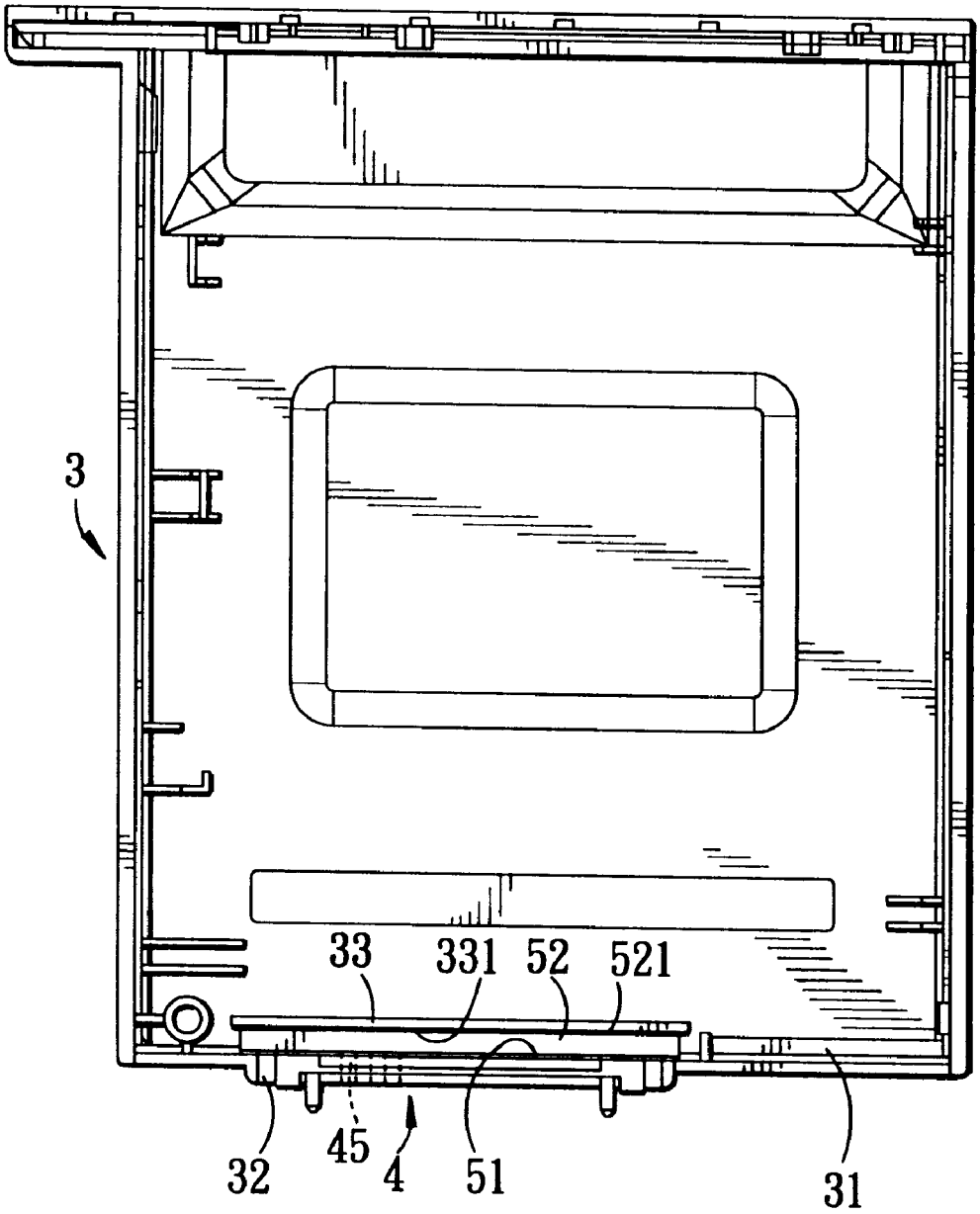
FIG. 4 is a top view of the preferred embodiment.

Referring to FIGS. 3 and 4, the preferred embodiment of an electronic device, such as a computer peripheral device, of the present invention is shown to include a housing 3, a barrier 33, and an electrical connector unit 4.

As illustrated, the housing 3 has a side wall 31 formed with an access opening 32 therethrough. The access opening 32 has a first length in a first direction, and a first width in a second direction transverse to the first direction.

The barrier 33, in the form of an elongated plate, is secured to the housing 3 and extends parallel to the side wall 31 such that the barrier 33 is spaced apart from the access opening 32 in a third direction transverse to the first and second directions so as to form a connector mounting space 400 between the barrier 33 and the side wall 31.

The electrical connector unit 4 includes a dielectric terminal holding seat 40, a contact terminal set 45, and a flexible ribbon cable 51. The dielectric terminal holding seat 40 is disposed in the housing 3, and has a front portion 401 that projects outwardly of the housing 3 through the access opening 32, and a rear portion 402 that extends from the front portion 401 in the third direction and that is disposed in the connector mounting space 400. The front portion 401 of the terminal holding seat 40 has a cross-section smaller than the size of the access opening 32 such that the terminal holding seat 40 is movable relative to the housing 3. The contact terminal set 45 is mounted in the terminal holding seat 40, and has a connector mating portion 451 disposed in the front portion 401 of the terminal holding seat 40, and a cable connecting portion 452 that extends in the third direction through the rear portion 402 of the terminal holding seat 40. The ribbon cable 51 has a terminal mounting plate 52 mounted on one end thereof in a conventional manner. The cable connecting portion 452 of the contact terminal set 45 is mounted on the terminal mounting plate 52 and is connected electrically to the individually insulated conductors of the ribbon cable 51. The terminal mounting plate 52 is disposed in the connector mounting space 400, and has an abutment face 521 in sliding contact with a contact face 331 of the barrier 33. Preferably, the contact face 331 of the barrier 33 has an area at least equal to that of the abutment face 521 of the terminal mounting plate 52 for providing adequate support to the electrical connector unit 4 upon mating with a complementary electrical connector 4' (see FIG. 8).

The front portion 401 of the terminal holding seat 40 has a second length in the first direction that is shorter than the first length of the access opening 32 to permit movement of the front portion 401 in the access opening 32 along the first direction, and a second width in the second direction that is narrower than the first width of the access opening 32 to permit upward and downward movement of the front portion 401 in the access opening 32. In the preferred embodiment, the first length and width of the access opening 32 are chosen to be longer or wider than the second length and width of the front portion 401 of the dielectric terminal holding seat by about 0.5 to 1 mm. The terminal mounting plate 52 has a third length in the first direction longer than the first length, and abuts slidably against an inner wall surface of the side wall 31 to prevent removal of the terminal holding seat 40 from the housing 3 via the access opening 32.

Figure 8:
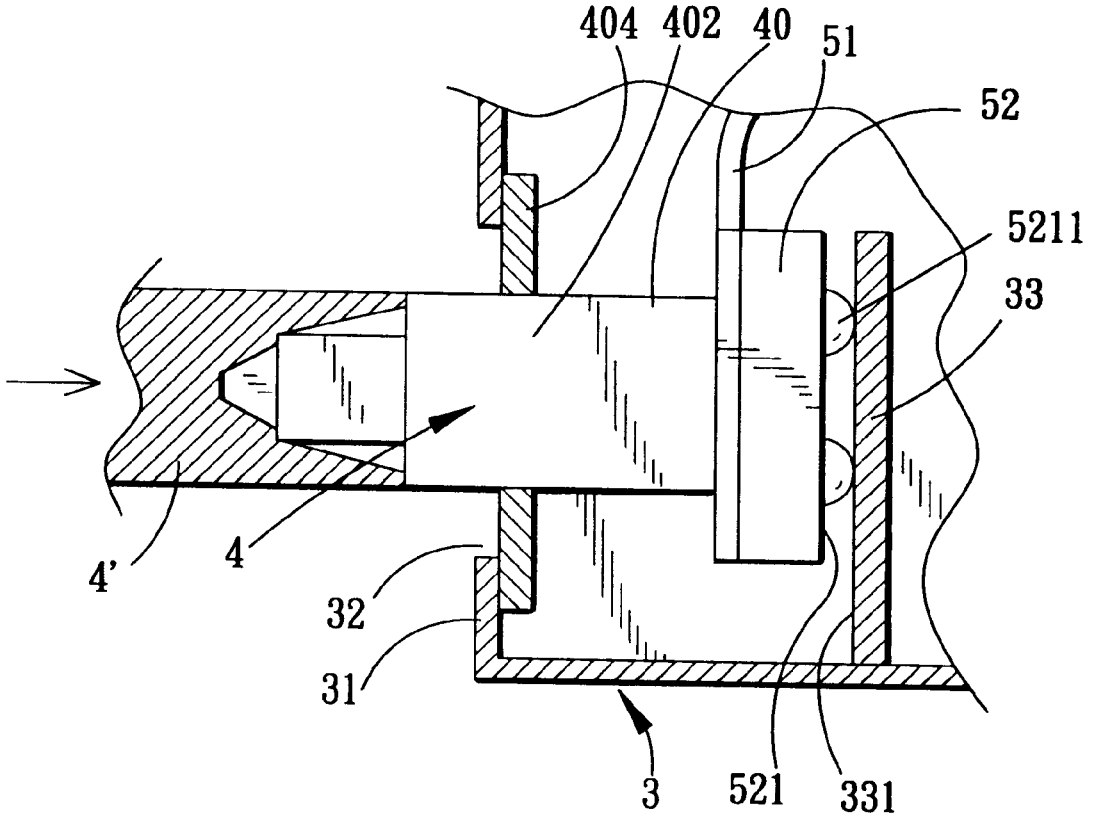
FIG. 8 is a side view of yet another preferred embodiment, illustrating how the electrical connector unit is prevented removal from a housing of the electronic device.

With reference to FIG. 8, in another preferred embodiment, the rear portion 402 of the terminal holding seat 40 is formed with a stop flange 404 that extends in the second direction and that abuts slidably against an inner wall surface of the side wall 31 to prevent removal of the terminal holding seat 40 from the housing 3 via the access opening 32.

Figure 5:
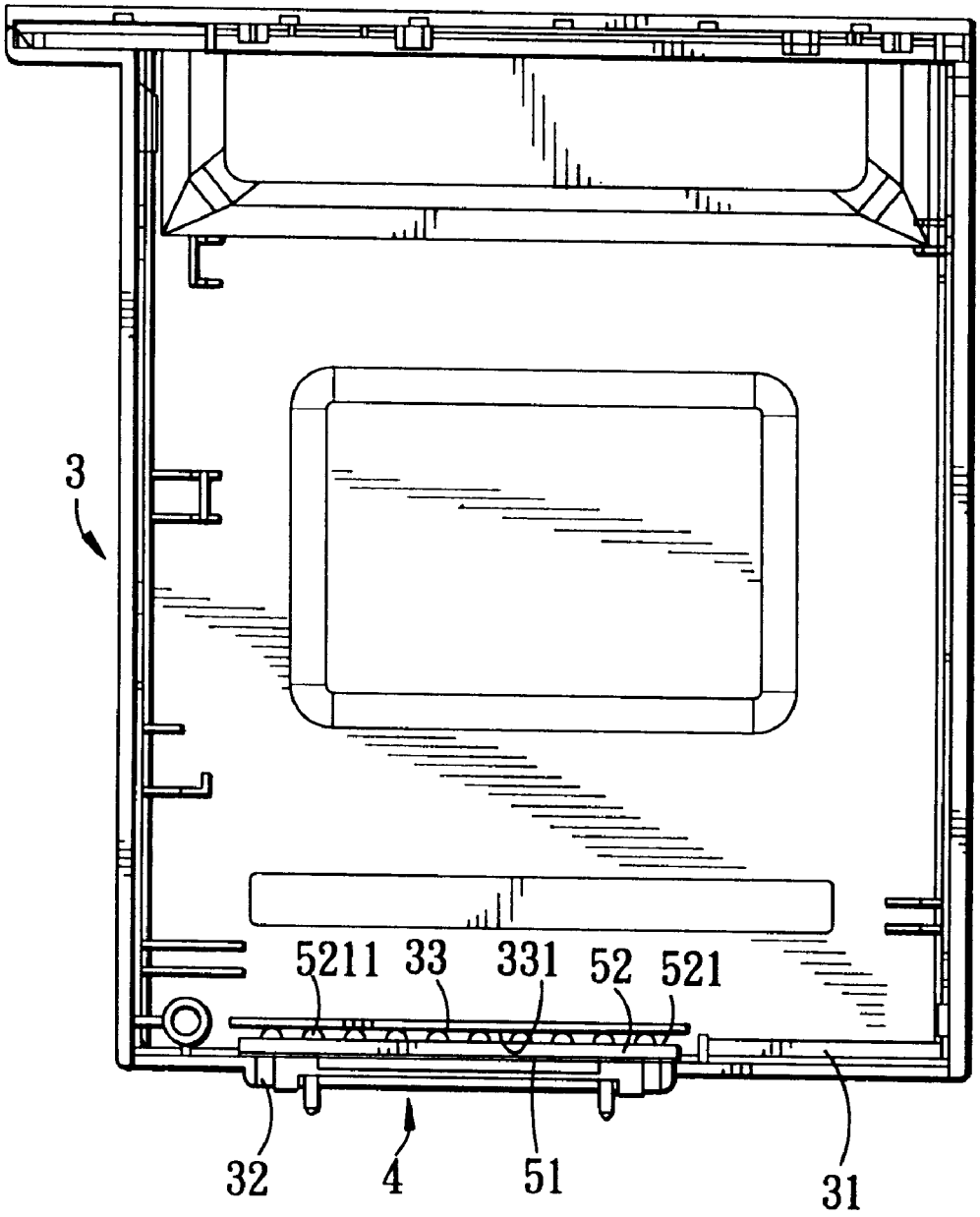
FIG. 5 is a top view of a modified preferred embodiment.
Figure 6:
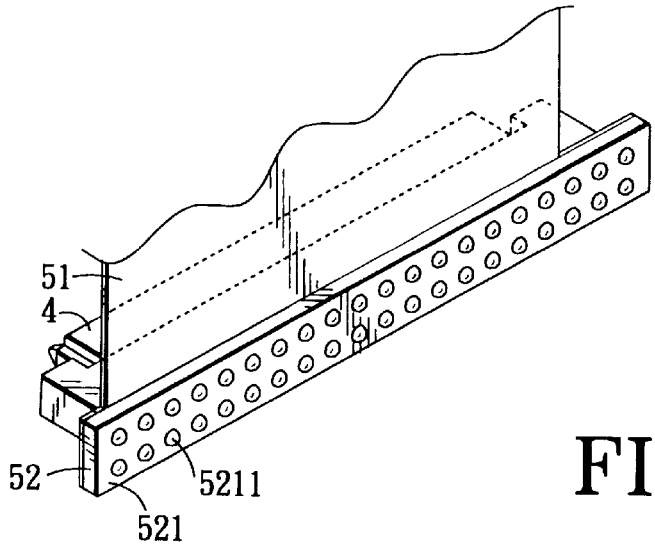
FIG. 6 is an enlarged view of an electrical connector unit of the modified preferred embodiment.
Figure 7:
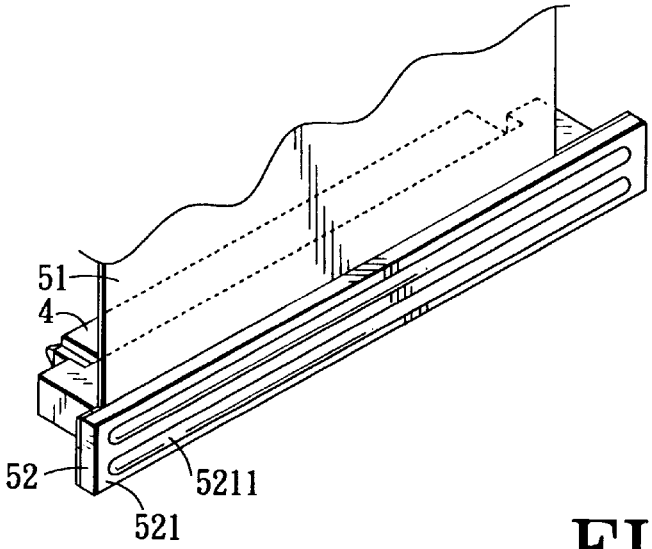
FIG. 7 is an enlarged view of an electrical connector unit of another modified preferred embodiment.

Referring to FIG. 5, in a modified preferred embodiment, the abutment face 521 of the terminal mounting plate 52 is formed with a plurality of protrusions 5211 to reduce friction between the terminal mounting plate 52 and the barrier 33. Each of the protrusions 5211 can be a convex protrusion, as best shown in FIG. 6. Alternately, each of the protrusions 5211 can be an elongated strip with a rounded cross-section, as shown in FIG. 7.

As explained above, since the terminal mounting plate 52 is slidable on the barrier 33, the terminal holding seat 40 is accordingly movable in the access opening along the first direction so as to register with a mating electrical connector unit 4' (see FIG. 8). In addition, the terminal mounting plate 52 will be stopped by the barrier 33 when the mating electrical connector unit 4' is thrusted into the electrical connector unit 4 to prevent deformation of the terminal mounting plate 52.

With this invention thus explained, it is apparent that numerous modifications and variations can be made without departing from the scope and spirit of this invention. It is therefore intended that this invention be limited only as indicated in the appended claims.

I claim:

1. An electronic device comprising:

a housing having a side wall formed with an access opening therethrough, said access opening having a first length in a first direction, and a first width in a second direction transverse to said first direction;

a barrier secured to said housing and extending parallel to said side wall, said barrier being spaced apart from said access opening in a third direction transverse to the first and second directions so as to form a connector mounting space between said barrier and said side wall; and an electrical connector unit including a dielectric terminal holding seat disposed in said housing and having a front portion that projects outwardly of said housing through said access opening, and a rear portion that extends from said front portion in the third direction and that is disposed in said connector mounting space, said front portion of said terminal holding seat having a cross-section smaller than size of said access opening such that said terminal holding seat is movable relative to said housing, a contact terminal set mounted in said terminal holding seat and having a cable connecting portion that extends in the third direction through said rear portion of said terminal holding seat, and a ribbon cable having a terminal mounting plate mounted on one end thereof, said cable connecting portion of said contact terminal set connecting electrically with said ribbon cable and being mounted on said terminal mounting plate, said terminal mounting plate being disposed in said connector mounting space and having an abutment face in sliding contact with a contact face of said barrier.

2. The electronic device as defined in claim 1, wherein said abutment face is formed with a plurality of protrusions to reduce friction between said terminal mounting plate and said barrier.

3. The electronic device as defined in claim 2, wherein each of said protrusion is a convex protrusion.

4. The electronic device as defined in claim 2, wherein each of said protrusion is an elongated strip with a rounded cross-section.

5. The electronic device as defined in claim 1, wherein said front portion of said terminal holding seat has a second length in the first direction that is shorter than the first length, and a second width in the second direction that is narrower than the first width.

6. The electronic device as defined in claim 5, wherein the first length is longer than the second length by about 0.5 to 1 mm, and the first width is wider than the second width by about 0.5 to 1 mm.

7. The electronic device as defined in claim 1, wherein said terminal mounting plate has a third length in the first direction longer than the first length and abuts slidably against an inner wall surface of said side wall to prevent removal of said terminal holding seat from said housing via said access opening.

8. The electronic device as defined in claim 1, wherein said contact face of said barrier has an area at least equal to that of said abutment face of said terminal mounting plate.

9. The electronic device as defined in claim 1, wherein said rear portion of said terminal holding seat is formed with a stop flange that extends in the second direction and that abuts slidably against an inner wall surface of said side wall to prevent removal of said terminal holding seat from said housing via said access opening.

* * * * *